United States Patent [19]

Chase

[11] 4,168,573

[45] Sep. 25, 1979

[54] COPYING EASEL

[76] Inventor: Herbert S. Chase, One Lincoln Plz., New York, N.Y. 10023

[21] Appl. No.: 859,348

[22] Filed: Dec. 12, 1977

[51] Int. Cl.[2] ..... B43L 13/00

[52] U.S. Cl. ..... 33/1 K; 33/277

[58] Field of Search ..... 33/1 K, 18 C, 20 R, 33/20 C, 276, 277; 35/26

[56] References Cited

U.S. PATENT DOCUMENTS

| | | | |
|---|---|---|---|
| 405,386 | 6/1889 | Worden | 35/26 |
| 981,177 | 1/1911 | Deem | 248/460 X |
| 2,352,615 | 7/1944 | Buckmaster | 33/20 R |
| 2,410,447 | 11/1946 | Juran | 33/20 C |
| 2,418,286 | 4/1947 | Austin | 35/26 |

FOREIGN PATENT DOCUMENTS

| | | | |
|---|---|---|---|
| 393014 | 6/1933 | United Kingdom | 248/441 A |

*Primary Examiner*—Harry N. Haroian
*Attorney, Agent, or Firm*—Wolder, Gross & Yavner

[57] ABSTRACT

A copying easel for copying three-dimensional objects including a support frame, a copy frame rotatably attached to the support frame and an open sighting awning rotatably attached to the support frame. The copy frame is constructed to cooperate with the support frame to support the device during use and includes a rigid, transparent copy base material over which is placed a removable, transparent, flexible copying medium upon which the copy is made. The sighting awning defines a sighting opening to view the object through the transparent copying medium and the transparent copy base. The awning further has sufficient thickness to block the vision of the unused eye and has two positioned indentations to accommodate the nose of the user depending upon which eye is to be used.

1 Claim, 11 Drawing Figures

Fig.4.
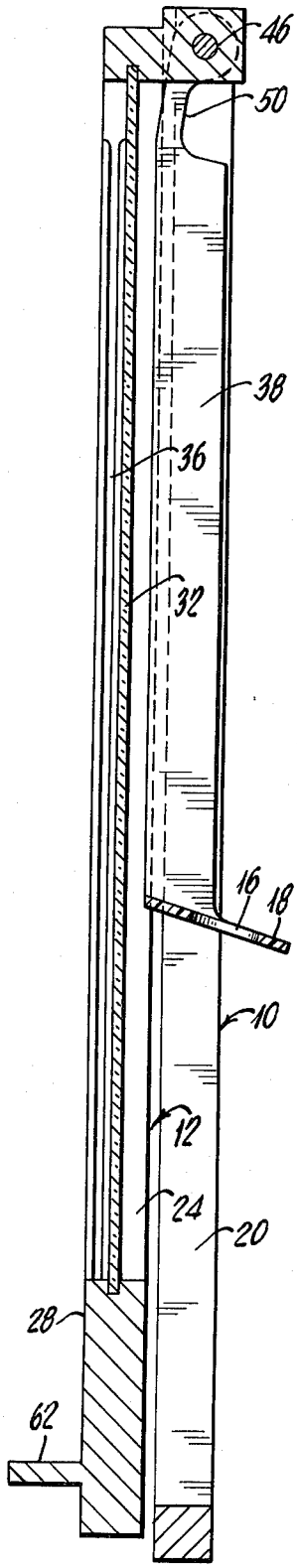
Fig.5.
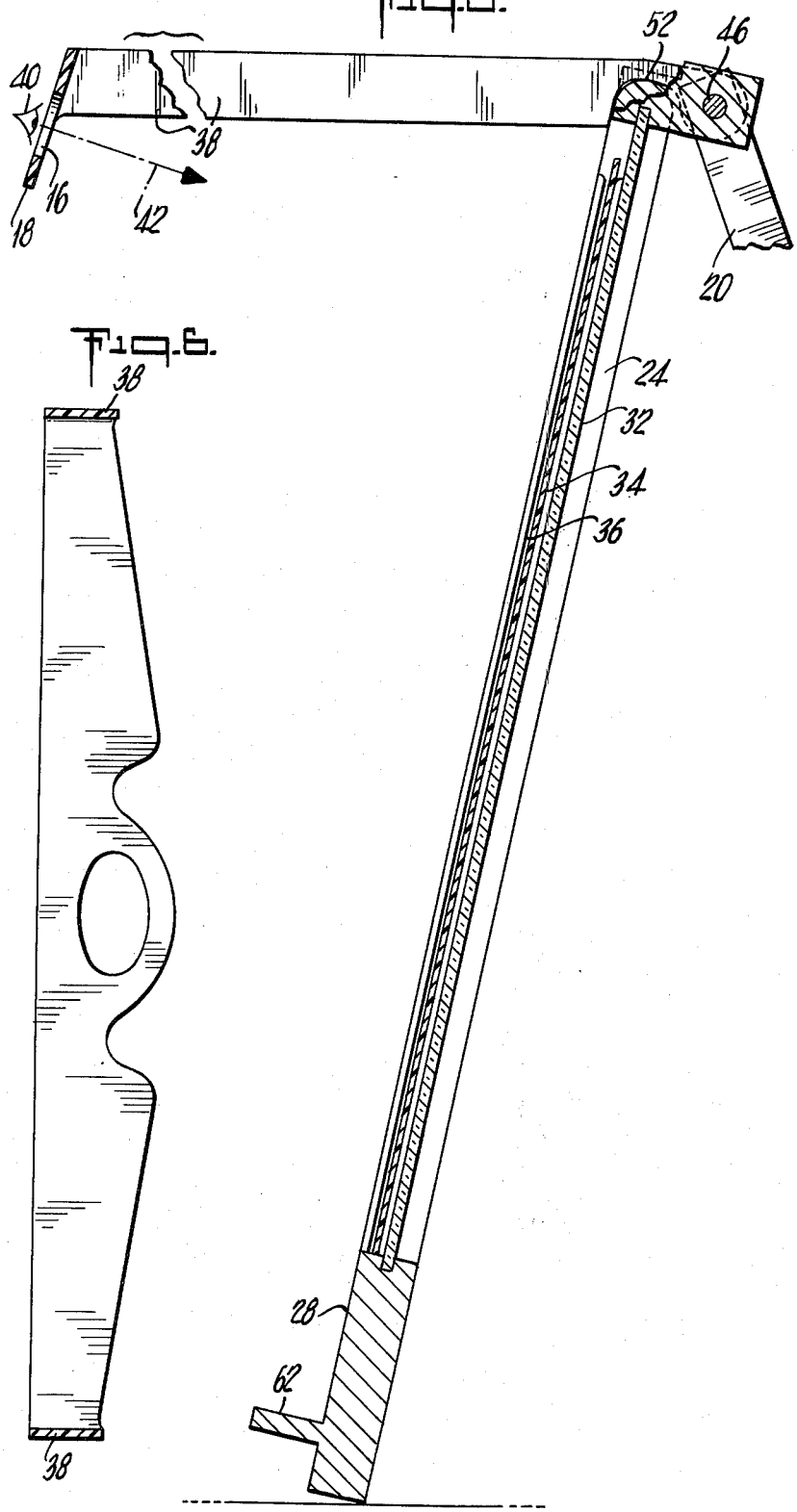
Fig.6.

COPYING EASEL

This invention relates primarily to easel constructions and, more particularly, to such constructions which are particularly useful for copying three-dimensional objects.

Easels may be generally divided into two categories, the first of which relate to simple painting easels and the second of which relate to those designated copying easels. The former requires a tripod or other base to support an angularly oriented frame surface upon which a painting or drawing is made. The latter is usually in the form of a support base and a tiltable transparent member through which an object is copied.

Those in the copying easel classification suffer from the drawbacks of undue complexity for the purposes intended. Furthermore, the copying medium is not usually in the form to allow for reusability. Also, such items are not as attractive as they could be; nor are they particularly portable.

Accordingly, a primary object of the present invention is to provide a copying easel for use in copying three-dimensional objects which is sturdy, attractive, portable and efficient in the accomplishment of its purpose.

A further object of the present inventon is to provide a copying easel which is useful in connection with a copying medium which may be reused.

A still further object of the present invention is to provide a copying easel which is foldable to a compact solid rectangular shape for ease of storing and which is easily opened to a sturdy attractive and efficient copying device.

These and other objects of the present invention are provided in a copying easel for copying three-dimensional objects which features a support frame, a copy frame rotatably attached to said support frame and an open, slightly awning rotatably attached to the support frame. The sighting awning defines a sighting opening and means are provided for positioning the rotatable awning for operation and use of the easel. The means for positioning includes stop slots defined by the copy frame which are located to stop the rotation of the awning in an orientation to provide an in-line position between the sighting opening, a point proximate the center of the copy frame and the object to be copied. The awning is of sufficient thickness to block the vision of the unused eye and contains two indentations positioned to accommodate the nose of the user depending upon which eye is to be used. The copy frame defines media slots into which are fitted a copying medium to overlie a rigid, transparent copy base fixedly held by the copy frame. Opening by rotation of the space between bases of the support frame and the copy frame provides support for the easel during use.

Other objects, features and advantages of the present invention will become apparent by reference to the following, more detailed description of a preferred, but nonetheless illustrative, embodiment when taken in conjunction with the accompanying drawings wherein:

FIG. 4 is a side, sectional view of the easel of the present invention taken along line 4—4 of FIG. 1;

FIG. 5 is a side, sectional view taken along the line 5—5 of FIG. 2;

FIG. 6 is a back sectional view taken along the line 6—6 of FIG. 2 and showing particularly the sighting opening defined by the sighting awning;

Figure 2:
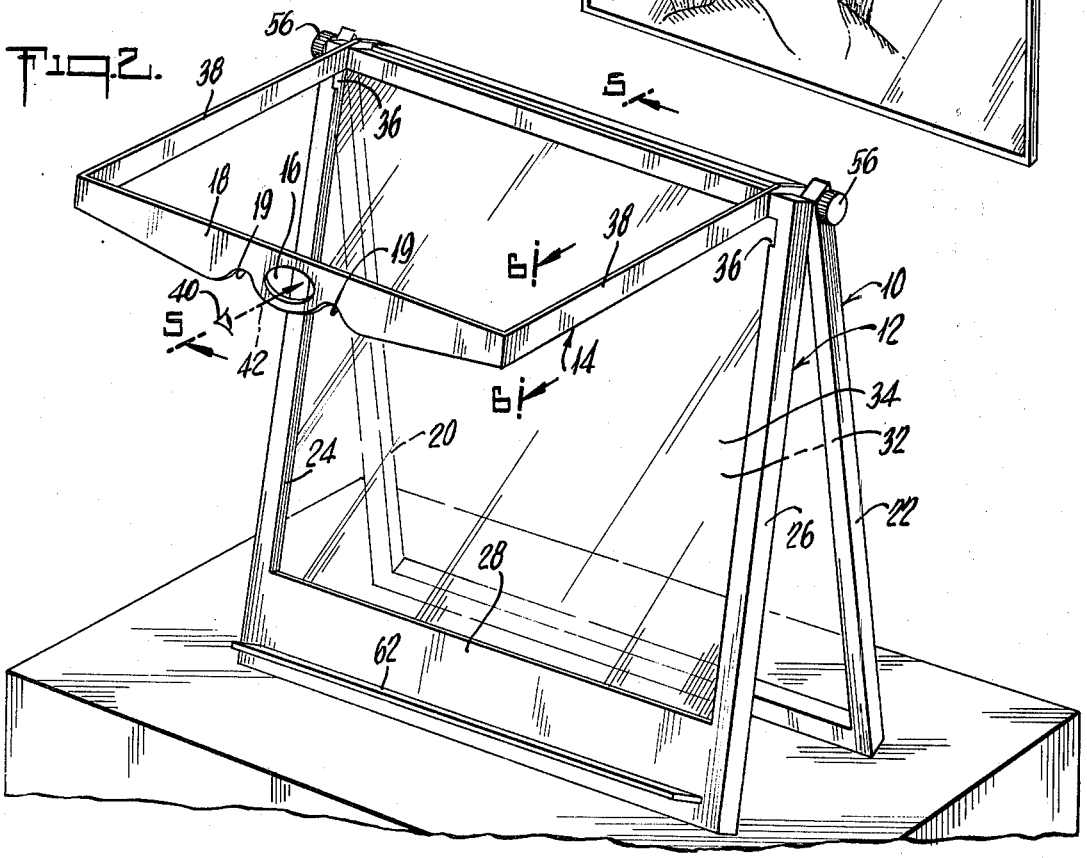
FIG. 2 is an isometric representation of an easel according to the present invention in use position showing the copy frame rotated to support the easel in conjunction with the support frame and the sighting awning rotated to correctly position the defined sighting opening for a copy operation.

Referring to the drawings, and particularly FIG. 2 thereof, an easel is shown as including a support frame generally designated 10 to which is rotatably attached a copy frame generally designated 12. Also rotatably attached to the support frame 10 is an open, sighting awning generally designated 14, which defines a sighting opening 16 in the sighting bar 28 thereof.

More particularly, FIG. 2 shows a use position for the easel of the present invention and support frame 10 includes a pair of support legs 20–22. Likewise, copy frame 12 includes a pair of support legs 24–26, with the support legs of the suport frame and of the copy frame supporting the easel during its use.

Copy frame 12 further includes bottom frame member 28 and top frame member 30, which with legs 24, 26 hold in a fixed position a rigid, transparent copy base 32 (FIG. 5). Overlying copy base 32 is a transparent, flexible copying medium 34 which fits within media slots 36 defined in the support legs of the copy frame, as seen more particularly in FIGS. 4 and 5.

Sighting awning 14 includes, in addition to sighting bar 18, a pair of support bars 38 which are perpendicular to sighting bar 18. On the other hand, sighting bar 18 is parallel to the planes of both support frame 10 and copy frame 12. The thickness of the sighting bar 18 on either side of the sighting opening 16 is of sufficient thickness to block the vision of the unused eye. Positioned on the bottom edge of the sighting bar and slightly to the side of the sighting opening 16 are a pair of symmetrical indentations 19 for the purpose hereinafter appearing.

In the position shown in FIG. 2, a copy of a three-dimensional or any other object may be made by placing same behind the easel for sighting through sighting opening 16. More specifically, as shown in FIG. 5, the copier's sighting is as depicted by eye 40, through sighting opening 16 as shown by arrow 42. Thus, the copier 40 looks through the sighting opening through copying medium 34 through transparent copy base 32 and to the object. The thickness of the sighting bar 18 is sufficient to block the unused eye. Since many people have difficulty looking with one eye closed, such a construction presents a decided and substantial advantage over other similar constructions. Furthermore, the indentations 19 located below and to either side of the opening 16 accommodate the nose of the viewer. If the left eye is used, the nose will be accommodated within the right indentation. If the right eye is used, the nose will be accommodated within the left indentation. He sketches or copies by drawing upon copying medium 34 which may be an acetate or the like which is reusable if markings thereon are made by a marking crayon, paints or the like.

Figure 1:
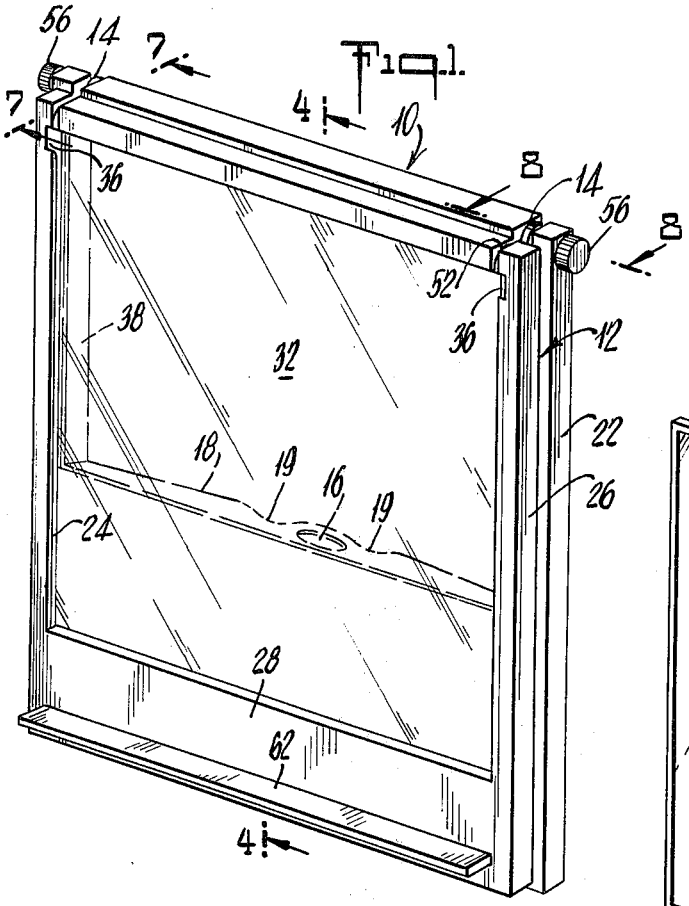
FIG. 1 is an isometric representation of an easel constructed according to the present invention showing particularly the storage position of the easel.

The storage position shown in FIG. 1 is assumed by rotating sighting awning 14 upwardly and backwardly with respect to the easel depicted in FIG. 2 and moving the pair of legs 24, 26 closer at the base to the pair of legs 20–22 as shown in FIG. 2, Thus, FIG. 1 represents a compact, almost perfectly shaped solid rectangle for storage convenience. FIG. 4 shows an excellent view of the storage capability of the easel of the present invention.

Figure 7:
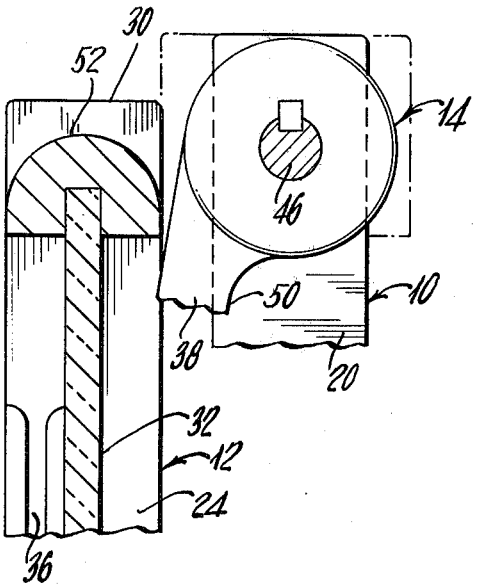
FIG. 7 is a partial, side, sectional view taken along the line 7—7 of FIG. 1 and showing particularly the interconnection of support frame and copy frame.

Referring to FIG. 7, the storage orientation at the intersection of support frame 10 and copy frame 12 is more conveniently depicted with the parts, including sighting awning 14 being held together in a rotatable configuration by pin 46.

Figure 9:
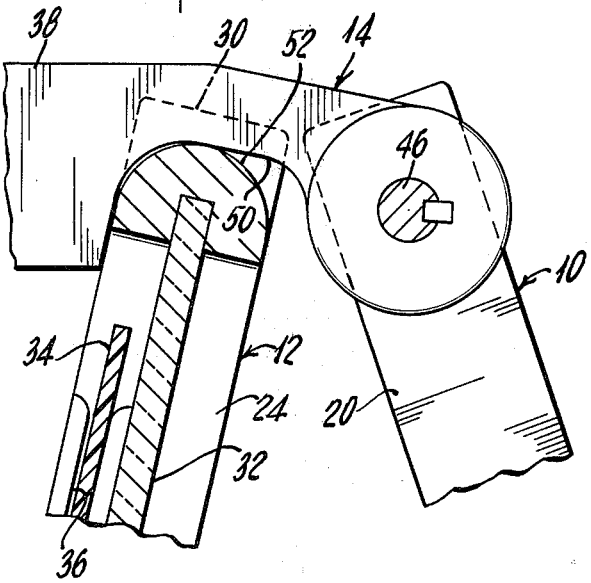
FIG. 9 is a view similar to that of FIG. 7, but showing the support frame and copy frame in rotated position with the awning in use position as held by the stop slot defined by the copy frame.
Figure 10:
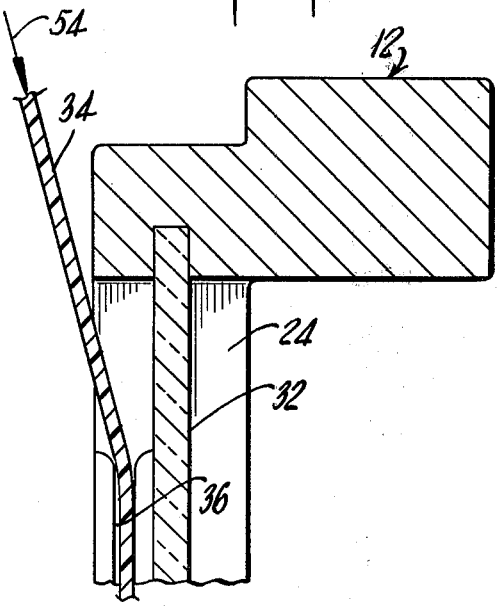
FIG. 10 is a view similar to that of FIG. 7, but showing particularly the copy frame and particularly its defined media slot for insertion of the copying medium.

FIG. 9 illustrates the use position of FIG. 2 and particularly the intersection of support frame 10, copy frame 12 and sighting awning 14. It should be particularly noted that sighting awning support bars 38 define stop contours 50 which mate with stop slots 52 defined by the top frame member 30 of copy frame 12. It should also be noted that copying medium 34 fits conveniently within media slots 36 defined by the support legs 24, 26 of copy frame 12. The motion for insertion is as shown in FIG. 10 in the direction depicted by the arrow 54.

Figure 8:
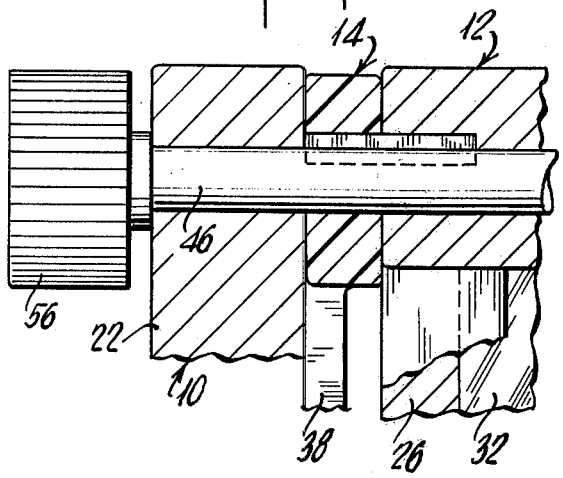
FIG. 8 is a back, partial, sectional view taken along the line 8—8 of FIG. 1 and showing particularly the interconnection of support frame and copy frame and the awning knob for rotating one with respect to the other.

FIG. 8 shows awning knob 56 which connects with pin 46 for holding copy frame 12, support frame 10 and sighting frame 14 together in a rotatable configuration.

Figure 3:
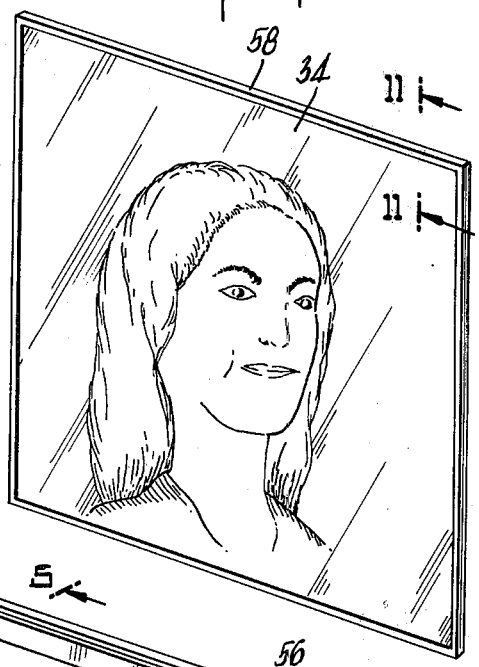
FIG. 3 is an isometric representation of a finished copy enclosed in a frame or tape after removal of the copying medium from the easel of FIG. 2.
Figure 11:
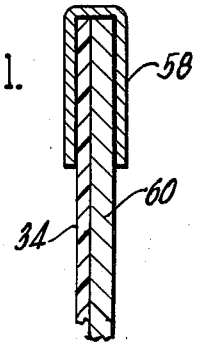
FIG. 11 is a partial, side, sectional view of the framed and backed finished copy taken along the line 11—11 of FIG. 3.

FIG. 11 shows the copying medium 34 after it has been removed from media slots 36 and placed in a frame or tape 58 with a separate backing 60. Such clearly illustrates, along with the showing of FIG. 3, the results that may be produced by use of the present invention.

As an additional feature, bottom frame member 28 of copy frame 12 is provided with a marker tray 62 as shown in FIGS. 1 and 2 for use in holding the copying tools used in the operation.

Furthermore, it is possible to attach legs to the frame in order to elevate the invention. It is further possible to makethese legs adjustable for variation in accordance with the height of the user.

Thus, a compact, sturdy, efficient and attractive easel is provided by the present invention which is particularly easy to operate with rotatable construction to enable ease and compactness of storage

What is claimed is:

1. A copying easel for copying three-dimensional objects by sighting said objects through a transparent copying medium mounted on and coplanar with a transparent, rigid copy base, comprising, in combination, a support frame including two legs, and a copy frame including two legs and a transparent, rigid copy base, rotatably attached to each other in an easel-type support configuration, an open, sighting awning rotatably attached to said support frame and defining a sighting opening therein, said copy frame defining stop slots therein for positioning said awning for operation and use of said easel by terminating the rotation of said sighting awning, said awning having a sighting bar defining said sighting opening and a pair of support bars perpendicular to said sighting bar for mating with said stop slots, said sighting bar further defining a pair of downwardly facing indentations on its lower edge and being of sufficient thickness to, respectively, accommodate the nose of the user, depending on which eye is aligned with the sighting opening for viewing therethrough said objects through said copying medium and said copy base, and for blocking the unused eye of the user, and said copy frame defining media slots for placement and removal of said copying medium adjacent said transparent, rigid copy base.

* * * * *